US006414539B1

(12) United States Patent
Srikanth et al.

(10) Patent No.: US 6,414,539 B1
(45) Date of Patent: Jul. 2, 2002

(54) AC TIMINGS AT THE INPUT BUFFER OF SOURCE SYNCHRONOUS AND COMMON CLOCK DESIGNS BY MAKING THE SUPPLY FOR DIFFERENTIAL AMPLIFIER TRACK THE REFERENCE VOLTAGE

(75) Inventors: Adhiveeraraghavan Srikanth, Folsom; Navneet Dour, Fair Oaks, both of CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/819,717

(22) Filed: Mar. 29, 2001

(51) Int. Cl.[7] ..... G05F 1/10
(52) U.S. Cl. ..... 327/540; 327/88
(58) Field of Search ..... 327/77, 83, 88, 327/89, 530, 534, 535, 540, 560, 561, 562, 563

(56) References Cited

U.S. PATENT DOCUMENTS 4,527,076 A * 7/1985 Matsuo et al. ..... 326/56
5,736,871 A * 4/1998 Goto ..... 326/115
5,861,771 A * 1/1999 Matsuda et al. ..... 323/313
5,973,521 A * 10/1999 Kim et al. ..... 326/87
6,087,893 A * 7/2000 Oowaki et al. ..... 327/537
6,124,732 A * 9/2000 Zilic et al. ..... 326/63

* cited by examiner

*Primary Examiner*—Jeffrey Zweizig
(74) *Attorney, Agent, or Firm*—Antonelli, Terry, Stout & Kraus, LLP

(57) ABSTRACT

A differential amplifier power supply is derived from the same source that generates the reference voltage for the differential amplifiers. This will ensure the direction of voltage level shifts of these two voltages to be in tandem. That is, these two voltages will move in the same direction due to any variations in the source since they are generated from the same regulator. In this way receiver timing errors can be significantly reduced in source synchronous and common clock interfaces.

15 Claims, 3 Drawing Sheets

AC TIMINGS AT THE INPUT BUFFER OF SOURCE SYNCHRONOUS AND COMMON CLOCK DESIGNS BY MAKING THE SUPPLY FOR DIFFERENTIAL AMPLIFIER TRACK THE REFERENCE VOLTAGE

FIELD

The present invention is directed to a power supply scheme where the differential amplifier supply and the reference supply will track each other, thereby reducing the receiver timing mismatches in source synchronous and common clock designs.

BACKGROUND

Computers and other types of electronic equipment often utilize a series of chips to perform different functions for the overall device. In each chip there is a core which performs the main function of the chip and is surrounded by an input/output (I/O) ring with each I/O device in the ring forming a communication link with another chip. Each of these I/O devices may be connected to the other chips by way of an interface.

The core logic devices can operate at a very high frequency, so it is important that the interfaces and I/O devices should operate as fast as possible to keep up with the core speed. One problem with such high speed signaling is the receiver timing errors, which are the errors that occur in source synchronous and common clock designs where there is a delay mismatch between the data signal and the strobe or clock signals. The strobe signals act as a clock to latch the data signals at a specific time. These errors may be caused by a number of different problems. One such problem is the slew rate mismatch between data and the strobe signals. Another is variation in the chips due to manufacturing process variations and a third is variation in the power supplies. Different chips have their own voltage supplies and also different parts of the overall device may rely on different power sources.

In particular, buffers are often used in the interface devices between chips. These buffers include differential amplifiers and other logic devices which process the input signals. The differential amplifiers require a reference voltage to which the input signal level is compared to determine its bit value. Variations in the voltage sources which supply the differential amplifier supply and reference voltage supply can result in unacceptable receiver timing errors.

BRIEF DESCRIPTION OF THE DRAWING(S)

The foregoing and a better understanding of the present invention will become apparent from the following detailed description of example embodiments and the claims when read in connection with the accompanying drawings, all forming a part of the disclosure of this invention. While the foregoing and following written and illustrated disclosure focuses on disclosing example embodiments of the invention, it should be clearly understood that the same is by way of illustration and example only and the invention is not limited thereto. The spirit and scope of the present invention are limited only by the terms of the appended claims.

The following represents brief descriptions of the drawings, wherein.

DETAILED DESCRIPTION

Figure 1:
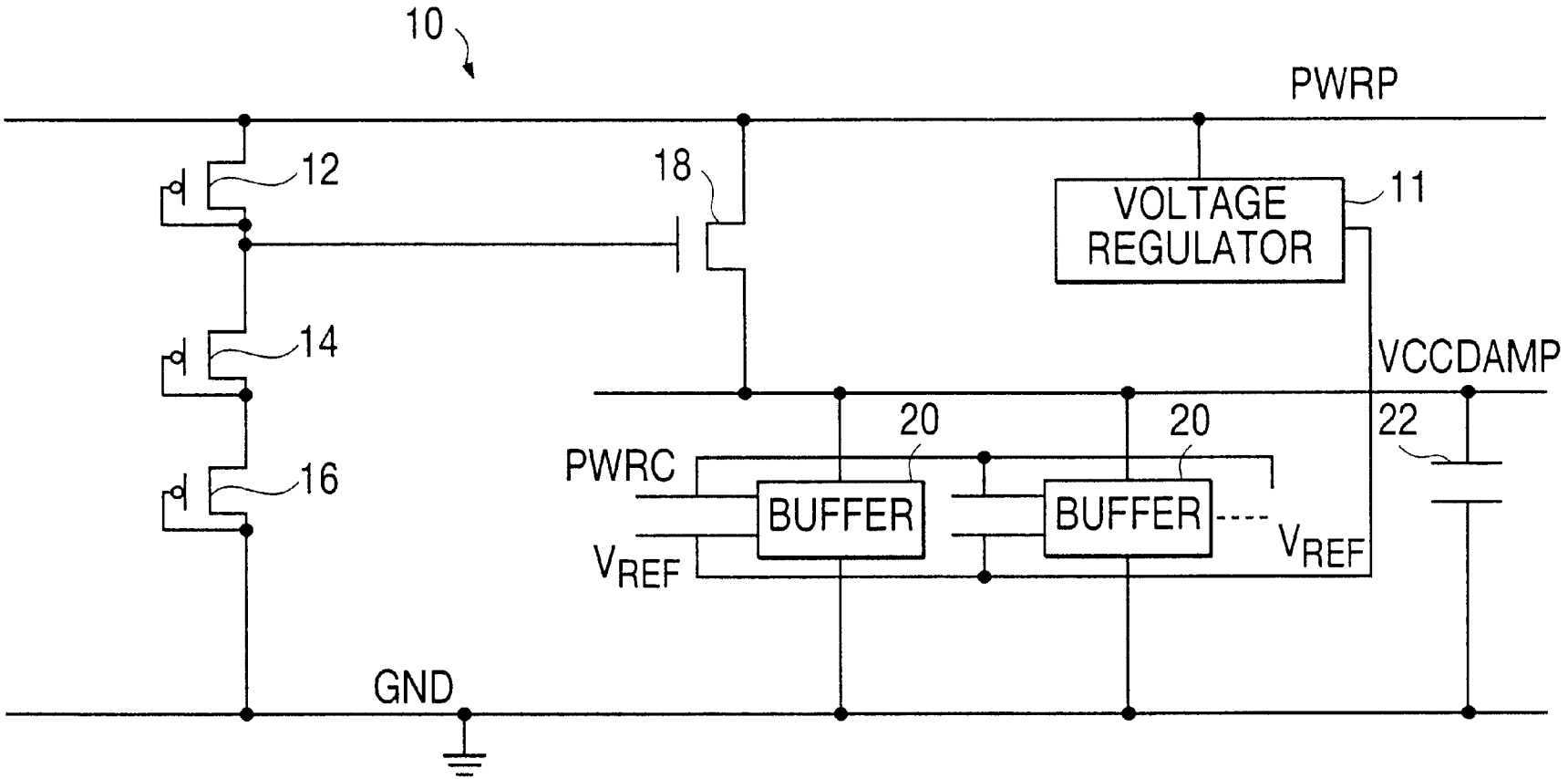
FIG. 1 is an example schematic diagram of an example simple system having an advantageous arrangement.

Before beginning a detailed description of the subject invention, mention of the following is in order. When appropriate, like reference numerals and characters may be used to designate identical, corresponding or similar components in differing figure drawings. Further, in the detailed description to follow, example sizes/models/values/ranges may be given, although the present invention is not limited to the same. As a final note, well known power/ground connections to ICs and other components may not be shown within the FIGS. for simplicity of illustration and discussion, and so as not to obscure the invention. Further, arrangements may be shown in block diagram form in order to avoid obscuring the invention, and also in view of the fact that specifics with respect to implementation of such block diagram arrangements is highly dependent upon the platform within which the present invention is to be implemented, i.e., specifics should be well within purview of one skilled in the art. Where specific details (e.g., circuits, flowcharts) are set forth in order to describe example embodiments of the invention, it should be apparent to one skilled in the art that the invention can be practiced without these specific details. Finally, it should be apparent that any combination of hard-wired circuitry and software instructions can be used to implement embodiments of the present invention, i.e., the present invention is not limited to any specific combination of hardware circuitry and software instructions.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

The present invention is designed to reduce the receiver timing errors caused by the power supply variations. The input buffers need a voltage (VCCDAMP) to bias the nodes and provide a tail current and a reference voltage (VREF) for comparing against the input signal to decide the logic level. Any shift in these two voltage levels is bound to cause timing errors. When both VCCDAMP and VREF shift levels in tandem (i.e. in the same direction) the receiver errors remain relatively low. However, when one supply is increasing while the other is decreasing, the voltage relationships between the two supplies change which causes the receiver timing errors to increase. In particular, the trip points, the voltage level which is the threshold between bit values, may be effected. As seen in the following table, the receiver errors are high when the two sources are changing in different directions. It is important to keep the amount of these shifts in voltage levels low as well.

| VREF | VCCDAMP | RECEIVER ERROR |
|---|---|---|
| INCREASE | INCREASE | LOW |
| INCREASE | DECREASE | HIGH |
| DECREASE | INCREASE | HIGH |
| DECREASE | DECREASE | LOW |

In order to avoid this problem, applicants have utilized a common power source for both the reference voltage and the differential amplifier power supply. In this invention, the VREF supply is from the same source which supplies the peripheral supply. By delivering the VCCDAMP from the peripheral supply, the VCCDAMP and VREF will track each other. Since both voltages are formed from the same original power supply, any drift that occurs will both be in the same direction, that is both increasing or both decreasing so that the of receiver timing errors is reduced.

FIG. 1 shows a power supply 10 including a single voltage regulator source 11 supplying PWRP for I/O and VREF for input buffers. Three transistors 12, 14 and 16 are connected between the PWRP and ground serially and act as a voltage divider. That is, an output is placed at the node between the first and second of the three transistors which extends to the gate of transistor 18. Transistor 18 also has another terminal connected to the power supply PWRP. The three transistors forming the voltage divider have resistances which are sized so as to give a proper voltage level so that transistor 18 can act as a current supply for the buffers. The voltage applied to the gate of transistor 18 is the PWRP voltage multiplied by the fraction $$\left(\frac{R_{14}+R_{16}}{R_{12}+R_{14}+R_{16}}\right).$$

Thus, by sizing the resistances of these transistors the voltage applied to the gate of transistor 18 can be determined.

Transistor 18 is an N-transistor which is a large device that can meet the peak-tail current requirements of the buffers. Transistor 18 acts as a current supply and provides the power for the input buffers as described below. The third terminal of transistor 18 is connected to the power supply rail VCCDAMP which is connected to the buffers. The voltage on this rail is equal to the voltage at the gate of transistor 18 minus the threshold voltage, of transistor 18.

The current supplied by transistor 18 powers the VCCDAMP rail to provide current to a series of buffers 20 which contain differential amplifiers and which receive input signals for the system. The buffers are connected between power supply VCCDAMP and ground. In addition to this power supply, the buffers also receive a reference voltage VREF and also receive other voltage inputs indicated by PWRC. Although only two buffers are shown as being connected, any number of buffers may be generated within the capabilities of the current supply 18.

A decoupling capacitor 22 is connected between the power supply rail VCCDAMP and the ground rail so as to filter switching or high frequency noise.

Figure 2:
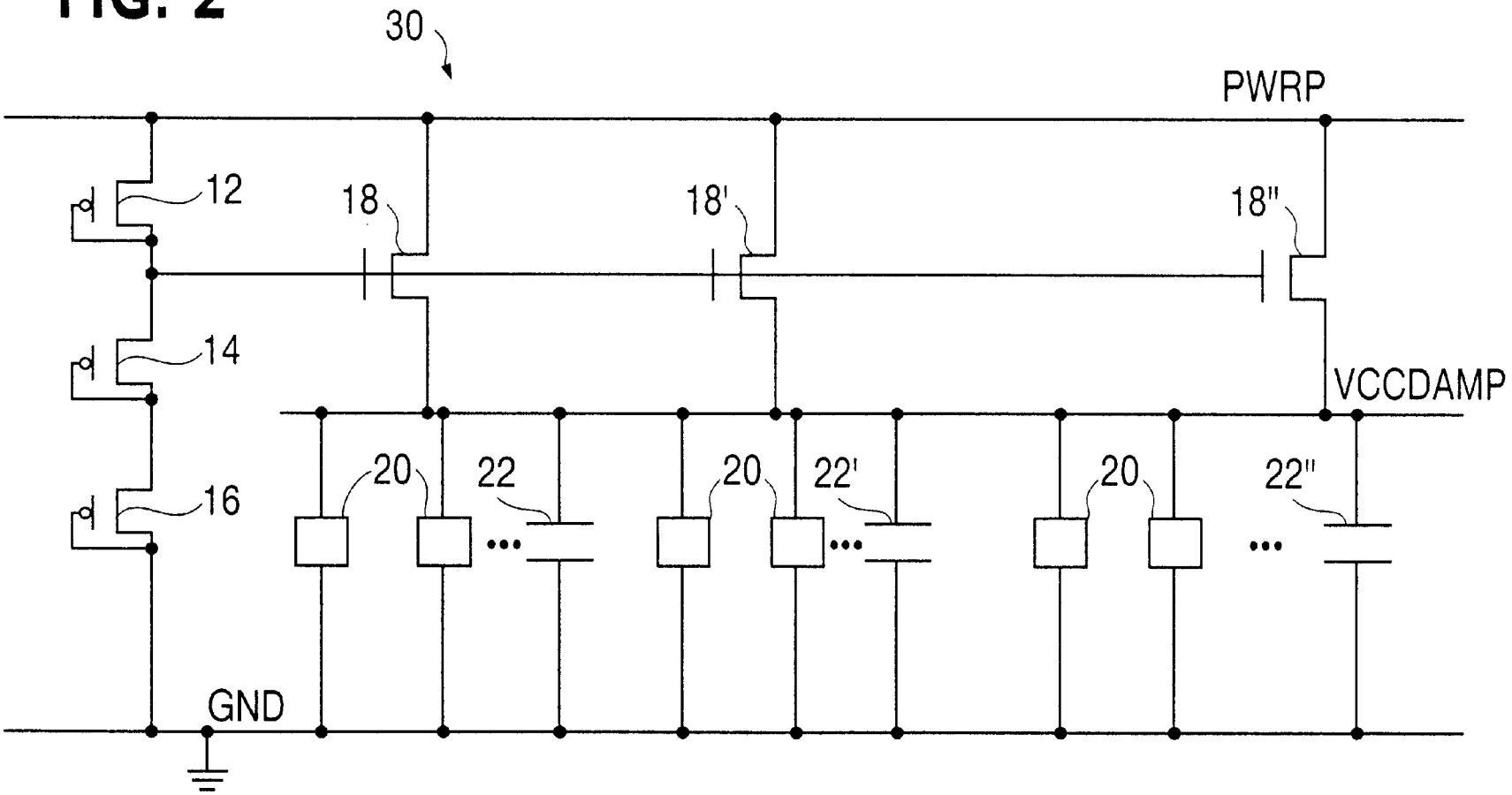
FIG. 2 is an example schematic diagram of an example complex system having an advantageous arrangement of the present invention.

FIG. 2 shows a more complex system 30 based on the same principle shown in FIG. 1. In this case, the larger number of buffers 20 which are present require a series of power supply transistors 18, 18', 18". Since the number of buffers which can be powered by such a power supply transistor is limited, additional power supplies must be utilized. However, the principle involved is the same and the voltage used to control all of these power supplies still comes from the same voltage divider. Also, decoupling capacitors 22, 22', 22" are provided with one for every power supply. However, depending on the nature of the circuitry, more or fewer of these decoupling capacitors can be utilized as necessary. FIG. 2 shows two of the buffers 20 followed by ". . . " for each power supply transistor 18. However, this number varies with design considerations and any number of buffers can be utilized as long as sufficient power is available through the current generators.

Figure 3:
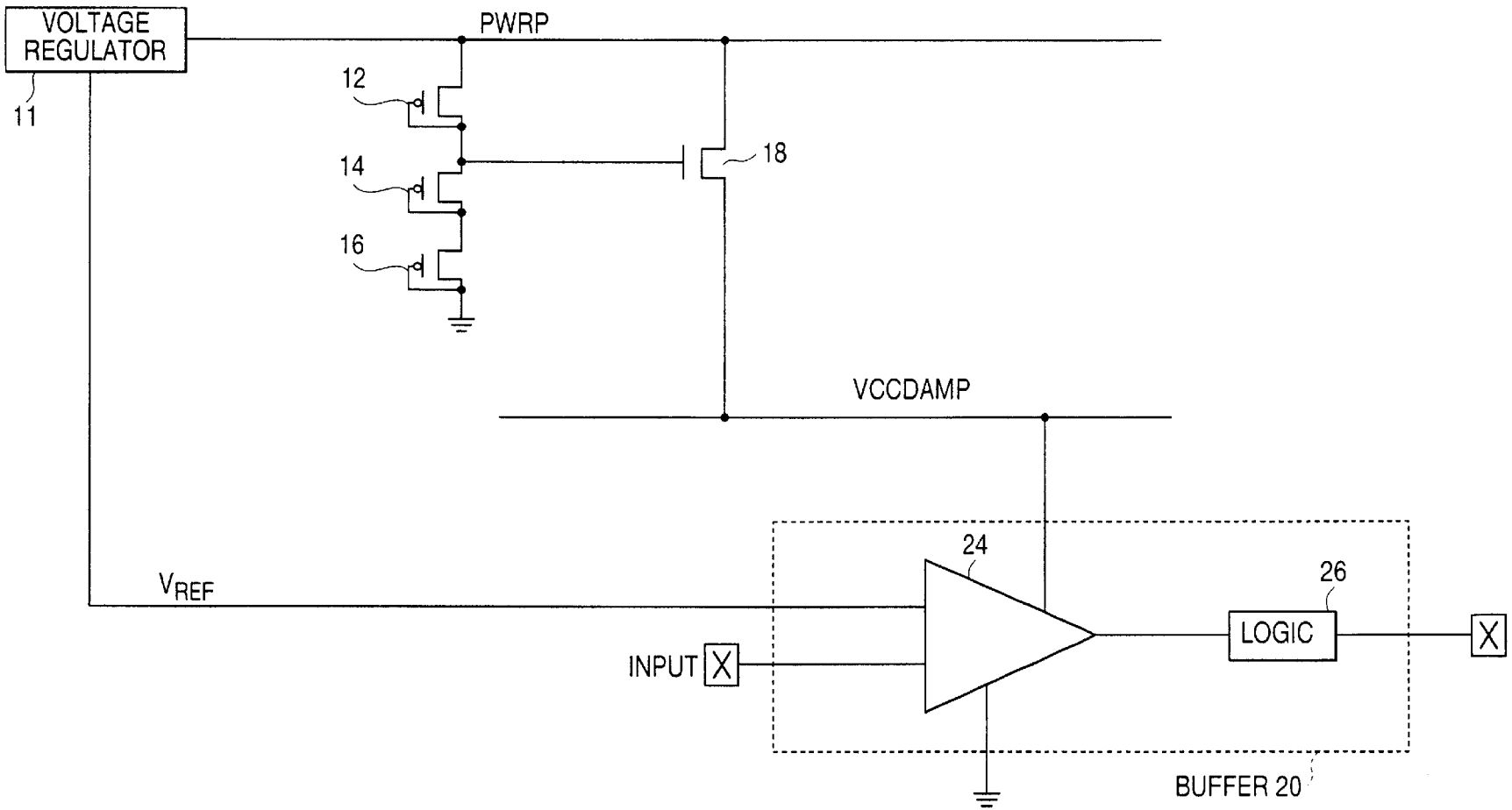
FIG. 3 is a simple example schematic showing the sources of differential amplifier power supply and reference voltage power supply.

FIG. 3 shows a simple schematic showing the sources of various power applied to an input buffer. Voltage regulator 11 is the source of both PWRP and VREF sources. Transistors 12, 14, 16 and 18 are used to form VCCDAMP from PWRP as described above. The input buffer 20 includes a differential amplifier 24 and logic gates 26. An input signal is applied to the differential amplifier and compared to VREF to determine if the input signal is larger or smaller than the reference voltage. This comparison output supply the logic gates which then produce an output signal.

By having the power supply voltage and the reference voltage of the buffers generated from the same source, the voltages track each other in terms of voltage drift and allow the differential amplifiers within the buffers to have low receiver timing skew . As a result, the timing margins between the data and strobe signals has been improved significantly thus improving the overall timing of the source synchronous interfaces of these systems.

This concludes the description of the example embodiments. Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. A method of reducing input receiver timing errors in a source synchronous and common clock interface circuit comprising:

providing a plurality of buffers in said interface circuit;

generating a reference voltage for said buffers from a same source that provides peripheral power supply;

generating a power supply for said buffers from said peripheral power supply;

causing said reference voltage for said buffers to track said power supply for said buffers due to their common source, so that timing errors are reduced.

2. The method according to claim 1, wherein said reference voltage for said buffers and said power supply for said buffers move in the same direction due to voltage drift.

3. The method according to claim 1, wherein said power supply for said buffers includes a plurality of transistors forming a voltage divider to provide a voltage level to a current supply transistor.

4. The method according to claim 3, wherein a plurality of current supply transistors are provided, each having associated therewith a plurality of buffers and a decoupling capacitor.

5. The method according to claim 1, wherein a decoupling capacitor is provided between said power supply for said buffers and ground.

6. An apparatus for reducing timing errors in a source synchronous and common clock interface circuit, comprising:

a plurality of buffers;

a reference voltage generating circuit for providing a reference voltage to said buffers;

a power supply generating circuit for providing power to said buffers;

a power supply source from which said reference voltage is generated and said power supply generating circuit is derived so that any drift between said reference voltage and said power supply occurs in the same direction, for reducing timing errors.

7. The apparatus according to claim 6, further comprising a decoupling capacitor connected between said power supply generating circuit and ground.

8. The apparatus according to claim 6, wherein said power supply source includes a plurality of transistors connected between said peripheral power supply and ground acting as a voltage divider and a current supply transistor receiving a voltage level from said voltage divider.

9. The apparatus according to claim 8, wherein said power supply transistor is a plurality of transistors, each having associated therewith a plurality of buffers and a decoupling capacitor.

10. The apparatus according to claim 6, wherein said reference voltage and said power supply drift in the same direction.

11. A power supply circuit for a differential amplifier in a source synchronous and common clock circuit comprising:

a plurality of transistors serially connected as a voltage divider between a peripheral power supply and ground;

a power supply transistor receiving an output from said voltage divider to provide a voltage level to control a current supply output;

said current supply output forming a power supply for differential amplifiers in said source synchronous interface circuit.

12. The apparatus according to claim 11, further comprising a decoupling capacitor connected between said power supply for said differential amplifier and ground.

13. The apparatus according to claim 11, wherein said differential amplifiers also receive a reference voltage which is generated from said peripheral power supply.

14. The apparatus according to claim 11, wherein said reference voltage and said power supply drift in the same direction so that timing errors in said source synchronous and common clock interface circuit are reduced.

15. The apparatus according to claim 11, wherein said current supply transistor is a plurality of transistors, each associated with a plurality of buffers and a decoupling capacitor.

* * * * *